United States Patent [19]

Ottley

[11] Patent Number: 4,590,371

[45] Date of Patent: May 20, 1986

[54] INLET SYSTEM FOR A MASS SPECTROMETER

[75] Inventor: Thomas W. Ottley, Royston, United Kingdom

[73] Assignee: Prutec Limited, United Kingdom

[21] Appl. No.: 618,467

[22] Filed: Jun. 8, 1984

[30] Foreign Application Priority Data

Jun. 10, 1983 [GB] United Kingdom ..... 8315956

[51] Int. Cl.[4] ..... H01J 49/04; H01J 49/24

[52] U.S. Cl. ..... 250/289; 250/288

[58] Field of Search ..... 250/288, 289

[56] References Cited

U.S. PATENT DOCUMENTS 3,385,102 5/1968 Briggs ..... 250/289

4,408,125 10/1983 Meuzelaar ..... 250/288

*Primary Examiner*—Alfred E. Smith

*Assistant Examiner*—Jack I. Berman

*Attorney, Agent, or Firm*—Lerner, David, Littenberg, Krumholz & Mentlik

[57] ABSTRACT

The invention relates to an inlet system for use in a mass spectrometer which comprises a capillary tube 10 for introducing ions for analysis into the ion source of the spectrometer. An expansion chamber 14 arranged at the end of the capillary tube 10 has an aperture sealingly connectable to a tube 16 containing a sample to be analyzed. A piston 18 disposed within the expansion chamber 14 acts as a closure member for opening and closing the said aperture. A pumping line 25 is provided for evacuating the expansion chamber 14 to low vacuum after communication is established between the expansion chamber and the sample tube 16 and the piston 18 seals off the pumping line from the expansion chamber 14 after a low vacuum has been achieved in the latter chamber to permit evacuation of the expansion chamber to 14 a higher vacuum by way of the capillary tube 10 to a diffusion pump evacuating the space within the mass spectrometer.

3 Claims, 2 Drawing Figures

INLET SYSTEM FOR A MASS SPECTROMETER

BACKGROUND OF THE INVENTION

1. Field of the Invention

The present invention relates to a pyrolysis inlet system for use with a mass spectrometer.

2. Description of the Prior Art

In a mass spectrometer, ions of a sample are analysed based upon their mass or mass-to-charge ratio in order to determine the ions present and their relative proportions. It is therefore necessary in various forms of mass spectrometers to be able to introduce the molecules to be analysed into the evacuated interior of the apparatus without affecting the vacuum within the apparatus.

In the prior art, the introduction of pyrolysate into the mass spectrometer relies upon a trap with an entry which may be opened to atmospheric conditions to allow the sample to be entered and which is then closed to seal off the sample from the atmosphere. The trap is then evacuated by a purposely provided pump, and when the desired vacuum conditions are reached a valve is opened to connect the trap to the interior of the mass spectrometer.

When the sample is under vacuum conditions, it is pyrolysed and the pyrolysate passes through an expansion chamber and a capillary tube to form a molecular beam for ionisation and subsequent analysis in the mass spectrometer. The need for the expansion chamber stems from the fact that on pyrolysis the pressure within the trap increases substantially and a large volume expansion chamber is required to broaden the pressure pulse so that the molecules travelling down the capillary tube for analysis should do so at a controlled rate, the differential pressure being excessive in the absence of such an expansion chamber.

The prior art system as described above, requires a complicated arrangement of pumps and gates which is expensive and cumbersome to implement and the invention seeks to provide an inlet system which mitigates these disadvantages.

SUMMARY OF THE PRESENT INVENTION

In accordance with the present invention, there is provided an inlet system for use in a pyrolysis mass spectrometer which comprises a capillary tube for the introduction of pyrolysate for analysis into the ion source of the spectrometer, an expansion chamber arranged at the end of the capillary tube, an aperture formed in the expansion chamber and sealingly connectable to a sample chamber containing a sample to be analysed, a valve closure member slidably disposed within the expansion chamber for opening and closing the said aperture, a pumping line for evacuating the expansion chamber to low vacuum after communication is established between the expansion chamber and the sample chamber and means for sealing off the pumping line from the expansion chamber after a low vacuum has been achieved in the latter chamber to permit evacuation of the expansion chamber to a higher vacuum by way of the capillary tube.

Conveniently, the means for sealing off the low vacuum pumping line is constituted by the same valve closure member as for the said aperture, the closure member being a piston of which one face serves to close the said aperture and the opposite face serves to isolate the low vacuum line.

Advantageously, the piston is arranged when in an intermediate position to isolate the capillary tube from the expansion chamber.

BRIEF DESCRIPTION OF THE DRAWINGS

The invention will now be described further, by way of example, with reference to the accompanying drawings, in which.

DESCRIPTION OF A PREFERRED EMBODIMENT

Figure 1:
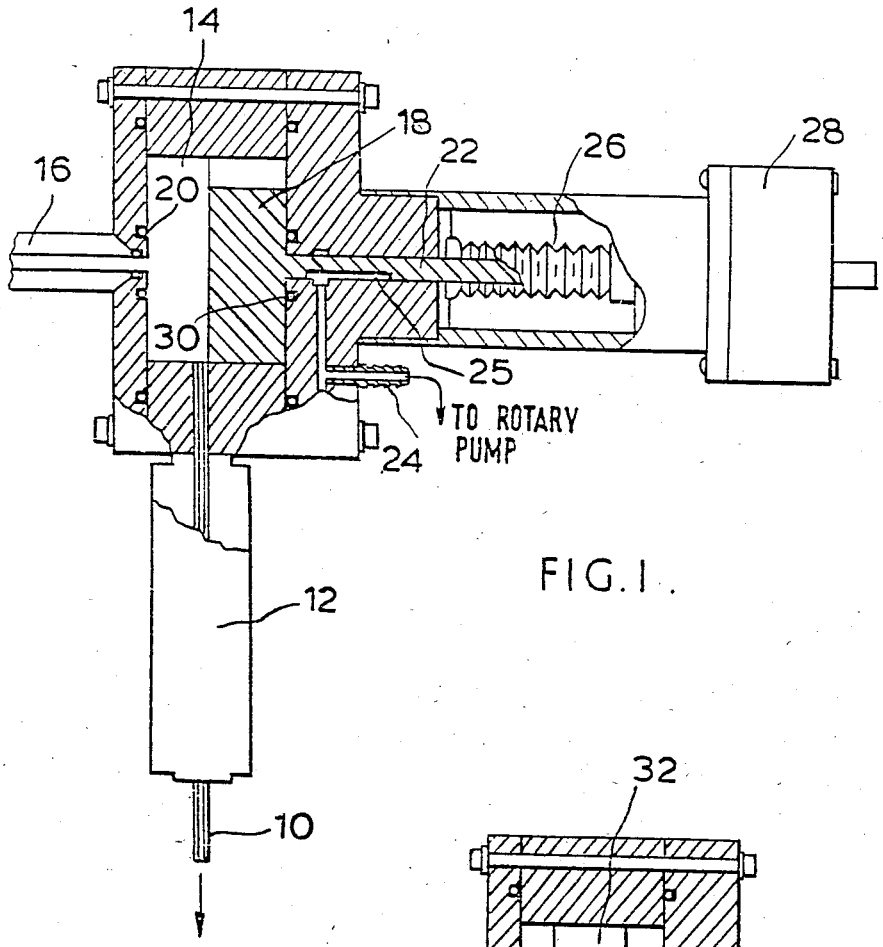
FIG. 1 is a schematic section through an inlet system for a mass spectrometer.

In FIG. 1, there is shown a capillary tube 10 through which molecules are introduced into the ion source of a mass spectrometer for analysis. The mass spectrometer need not be considered in detail within the context of the present application but it is mentioned by way of background that the inlet system in FIG. 1 is intended for use with a quadrupole mass spectrometer in which the ions are accelerated and pass down a quadrupole structure which acts as a filter only permitting ions of a certain mass-to-charge ratio to reach a collector electrode. The inlet system may however be employed with any other form of mass spectrometer.

The capillary tube 10 is surrounded by a heating jacket 12 and opens at its upper end as viewed into an expansion chamber 14 which is connected to a sample chamber, here constituted by a sample tube 16.

The sample tube 16 contains the sample to be analysed and during use a coil surrounding the tube 16 is used to heat and pyrolyse the sample which rests on a metal boat. The vapour enters the expansion chamber 14 and there expands to reduce its pressure, the reduced pressure serving to drive the vapour at a slower rate through the capillary tube 10 towards the accelerating electrode of the electrode structure. The purpose of the heating jacket 12 is to prevent particles from being deposited on the inner surface of the capillary tube 10. The presence of an expansion chamber is conventional in pyrolysis mass spectrometer systems and the usual manner of connecting it to the sample tube is for there to be provided isolation valves between the expansion chamber and the sample tube 16 which enable the sample tube to be evacuated by a separate pump before the valve is opened to establish communication between the sample tube and the expansion chamber.

In the system shown in FIG. 1, a piston 18 is reciprocable within the expansion chamber 14 and a seal in the form of an O-ring 20 is provided around the mouth of the aperture which opens into the sample tube 16. The piston has a piston rod 22 which is formed with an axially extending recess 25 which acts as part of a valve for connecting the expansion chamber 14 to a rotary pump connected to a port 24. The end of the piston rod 22 is connected to a bellows 26 acting as a vacuum seal, the rod being movable by means of a motor 28.

Figure 2:
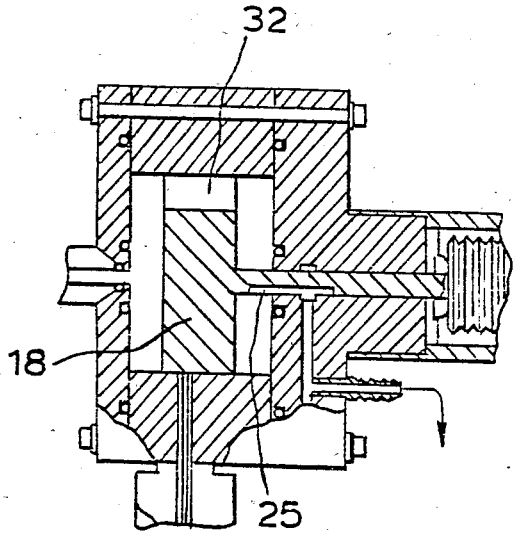
FIG. 2 shows a detail of a section in FIG. 1 with the piston in an alternative position.

The piston 18, when in its extreme right position as viewed, seals against a second seal 30 so that the expansion chamber 14 is isolated from the rotary pump. When the piston moves slightly to the left, into the position shown in FIG. 2, it seals off the end of the capillary tube 10 but also establishes communication between the expansion chamber 14 and the rotary pump through the recess 25 in the piston rod 22. The piston is provided with a passage 32 so that it permits communication between the spaces on its opposite sides and consequently in the position in FIG. 2 both the sample tube and the expansion chamber 14 are evacuated by means of the rotary pump.

In use, if it is desired to introduce a sample into the spectrometer the piston 18 is first moved to the left as viewed in FIG. 1 to seal against the seal 20 at the same time sealing off the end of the capillary tube 10 so as not to permit entry of any gases into the spectrometer.

The sample tube 16 is now secured in position. For example, it may seal against a further O-ring arranged outside the expansion chamber 14 or it may be screwed in position. The piston 18 is then moved to the position shown in FIG. 2 permitting the air from the sample tube 16 to enter the expansion chamber 14 which until this time has been under high vacuum. This causes a rise in pressure but only for a short time because the rotary pump which has a high displacement rapidly reduces the pressure in the expansion chamber 14 to provide a low vacuum. Once a sufficiently low pressure has been reached in the expansion chamber 14, the piston 18 is moved to the right sealing against the seal 30 and now isolating the expansion chamber 14 from the rotary pump and opening the capillary tube. The interior space of the spectrometer is permanently evacuated by means of a diffusion pump and the same diffusion pump will now take relatively little time to evacuate the expansion chamber 14 through the capillary tube 10. Once the vacuum within the expansion chamber 14 is sufficiently good, the sample is pyrolysed to allow molecules to enter the spectrometer for anlaysis.

It will be seen that the inlet system described makes use of a relatively simple arrangement which allows the expansion chamber 14 also to act as an airlock. Furthermore, the provision of a piston within the expansion chamber 14 allows the same rotary and diffusion pumps are used to evacuate the interior of the spectrometer to be used to evacuate sample tube without the need for a complex arrangement of valves.

In addition to simplifying the valving and thereby reducing costs, the arrangement reduces the risk of leakage and the time necessary to introduce a new sample since the total amount of air which is allowed to enter the system, and which must be removed before analysis can commence, amounts to no more than the volume of the sample tube itself.

I claim:

1. An inlet system for use in a pyrolysis mass spectrometer which comprises a capillary tube for the introduction of pyrolysate for analysis into the ion source of the spectrometer, an expansion chamber arranged at the end of said capillary tube, a sample chamber for containing a sample to be analysed, said sample chamber including an aperture enabling said sample chamber to communicate with said expansion chamber, a piston slidably disposed within said expansion chamber and having one axial end for opening and closing said aperture, and a pumping line for evacuating said expansion chamber to low vacuum after communication is established between said expansion chamber and said sample chamber, said piston additionally sealing off said pumping line from said expansion chamber after a low vacuum has been achieved in said latter chamber to permit evacuation of said expansion chamber to a higher vacuum by way of said capillary tube.

2. An inlet system as claimed in claim 1 wherein said piston includes a second axial end for sealing off said pumping line from said expansion chamber after a low vacuum has been achieved in said latter chamber to permit evacuation of said expansion chamber to a higher volume by way of said capillary tube.

3. An inlet system as claimed in claim 2, wherein said piston is arranged, when in an intermediate position, to isolate said capillary tube from said expansion chamber.

* * * * *